US010620569B2

(12) United States Patent
Jimba et al.

(10) Patent No.: US 10,620,569 B2
(45) Date of Patent: Apr. 14, 2020

(54) DEVELOPER SUPPLY CONTAINER

(71) Applicant: CANON KABUSHIKI KAISHA, Tokyo (JP)

(72) Inventors: Manabu Jimba, Tsukuba (JP); Yusuke Oizumi, Toride (JP); Kuniyoshi Sugawara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/387,935

(22) Filed: Apr. 18, 2019

(65) Prior Publication Data

US 2019/0324385 A1 Oct. 24, 2019

(30) Foreign Application Priority Data

Apr. 19, 2018 (JP) ..... 2018-080905

(51) Int. Cl.
*G03G 15/08* (2006.01)

(52) U.S. Cl.
CPC ..... *G03G 15/0889* (2013.01)

(58) Field of Classification Search
CPC ..... G03G 15/0889
See application file for complete search history.

(56) References Cited

U.S. PATENT DOCUMENTS 9,348,261 B2 5/2016 Enokuchi et al.
9,588,461 B2 3/2017 Kamura et al.
10,088,775 B2 10/2018 Kamura et al.
10,261,441 B2 4/2019 Jimba et al.
10,295,956 B2 5/2019 Enokuchi et al.
2012/0014713 A1* 1/2012 Murakami ..... G03G 15/0865 399/119
2012/0014722 A1 1/2012 Okino et al.
2014/0153974 A1* 6/2014 Jimba ..... G03G 15/0879 399/262
2016/0004186 A1 1/2016 Jimba et al.
2016/0139536 A1* 5/2016 Okino ..... G03G 15/0812 399/262
2016/0223981 A1 8/2016 Enokuchi et al.
2017/0060029 A1* 3/2017 Yomoda ..... G03G 15/0886
2017/0343925 A1* 11/2017 Saito ..... G03G 15/0868
2018/0024465 A1 1/2018 Yomoda et al.
2019/0204778 A1 7/2019 Gamo et al.
2019/0212672 A1 7/2019 Gamo et al.
2019/0212694 A1 7/2019 Katayama et al.

FOREIGN PATENT DOCUMENTS

JP 2010-256894 A 11/2010

* cited by examiner

*Primary Examiner* — G. M. A Hyder
(74) *Attorney, Agent, or Firm* — Venable LLP

(57) ABSTRACT

A developer supply container includes a developer accommodating body, a developer discharging body, a storing portion, provided a pump portion capable of changing a volume thereof with a reciprocating operation, and a rotatable member including a plurality of blades. The number of said blades is not less twice the number of times, per rotation of the rotatable member, of the reciprocating operation of the pump portion.

8 Claims, 14 Drawing Sheets

(a)

(b)

(a)

(b)

(c)

(a)

(b)

(a)

(b)

(a)

(b)

(a)

(b)

(a)

(b)

DEVELOPER SUPPLY CONTAINER

FIELD OF THE INVENTION AND RELATED ART

The present invention relates to a developer supply container suitable for use with an image forming apparatus, such as a printer, a copying machine, a facsimile machine or a multi-function machine, using electrophotography.

Conventionally, in electrophotographic image forming apparatuses such as copying machines, a developer such as toner of fine powder has been used. In such an image forming apparatus, the developer consumed by image formation is supplemented from a developer supply container. As a constitution of the developer supply container, for example, a constitution in which the developer accommodated in the developer supply container is discharged through a discharge opening of a communicating portion depending on a suctioning and discharging operation of a bellow-shaped pump capable of changing a volume thereof has been proposed (Japanese Patent No. 5623109). In such a constitution, in the case where the pump is expanded, pressure in the developer supply container is in a state in which the pressure is lower than atmospheric pressure (ambient pressure), and thus air flows into the developer supply container through the discharge opening (suction of air), so that the developer in the developer supply container is fluidized. On the other hand, in the case where the pump is compressed, the developer supply container is in a state in which the pump is higher than the atmospheric pressure, and thus the air flows out of the developer supply container through the discharge opening due to a difference in pressure between an inside and an outside of the developer supply container (discharge of air), so that the developer in the developer supply container is discharged through the discharge opening.

In recent years, there is a demand such that the developer in a large amount is intended to be discharged by a single suctioning and discharging operation, and in order to meet the demand, a bulk density of the developer in the neighborhood of the discharge opening is made high. However, conventionally, in the case where the bulk density of the developer in the neighborhood of the discharge opening is high, the developer was not readily discharged by the suctioning and discharging operation with the pump.

SUMMARY OF THE INVENTION

A principal object of the present invention is to provide a developer supply container capable of stably discharging a developer in a constitution in which the developer in the developer supply container is discharged by a suctioning and discharging operation with a pump.

According to an aspect of the present invention, there is provided a developer supply container comprising: a developer accommodating body configured to accommodate a developer; a developer discharging body communicating with the developer accommodating body and provided with a discharge opening through which the developer is dischargeable, wherein the developer accommodating body is rotatable relative to the developer discharging body; a storing portion communicating with an inside and the discharge opening of the developer discharging body and configured to store the developer dischargeable through the discharge opening, wherein the storing portion is provided with an opening through which the developer in the developer discharging is capable of entering the storing portion; a pump portion capable of changing a volume thereof with a reciprocating operation for a discharging operation discharging the developer stored in the storing portion and a suctioning operation suctioning air; and a rotatable member including a plurality of blades and rotatable about a rotational axis of the developer accommodating body so as to pass through a region opposing the opening of the storing portion, wherein a number of the blades is not less than twice a number of times, per rotation of the rotatable member, of the reciprocating operation of the pump portion.

Further features of the present invention will become apparent from the following description of exemplary embodiments with reference to the attached drawings.

Figure 3:
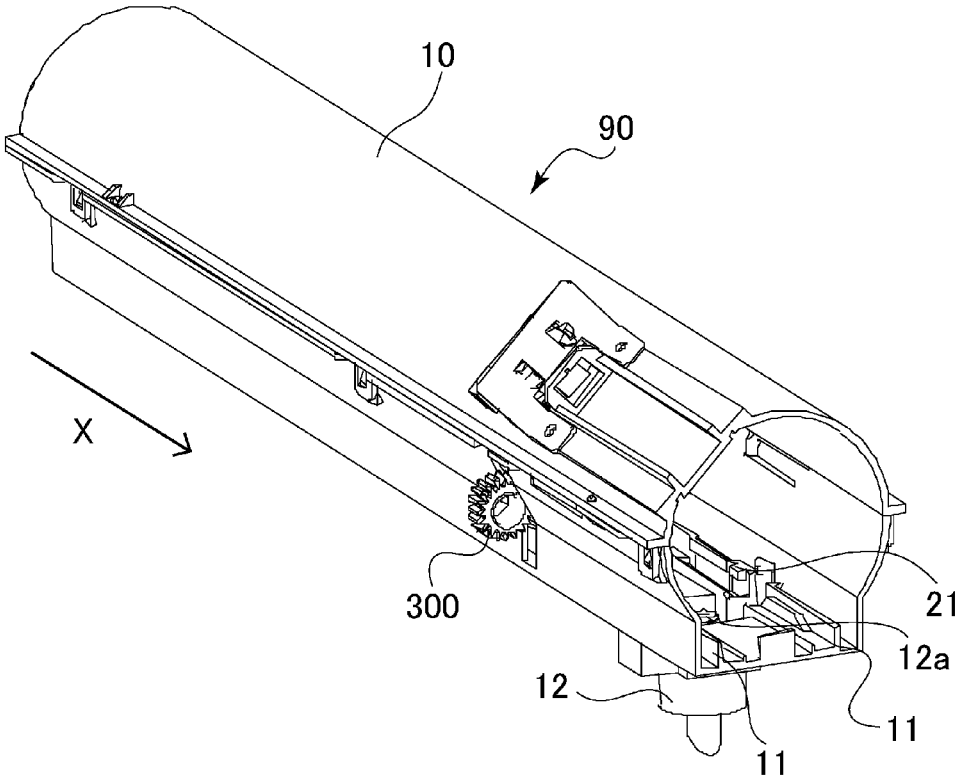
Figure 3:
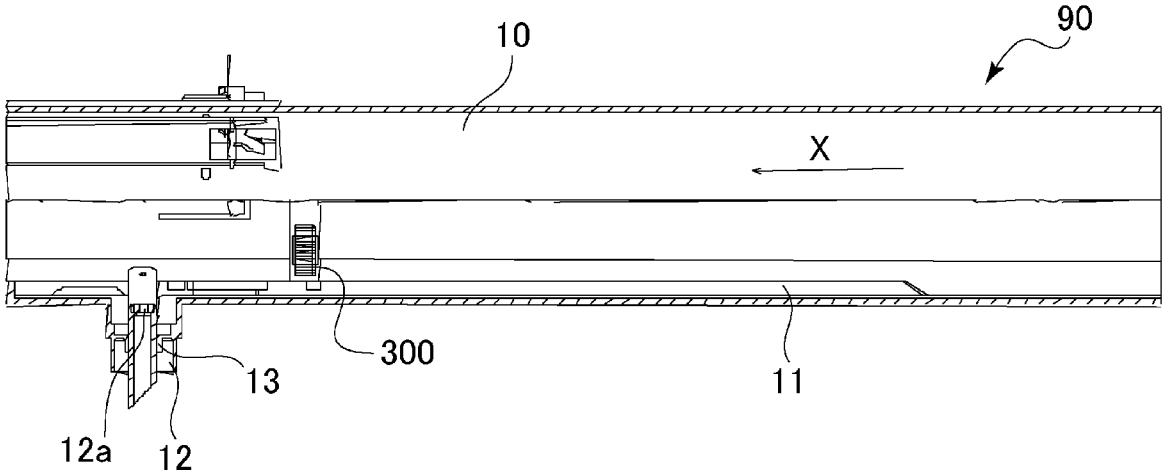

Part (a) of FIG. 3 is perspective view of a developer receiving apparatus, and part (b) of FIG. 3 is a sectional view of the developer receiving apparatus.

Figure 4:
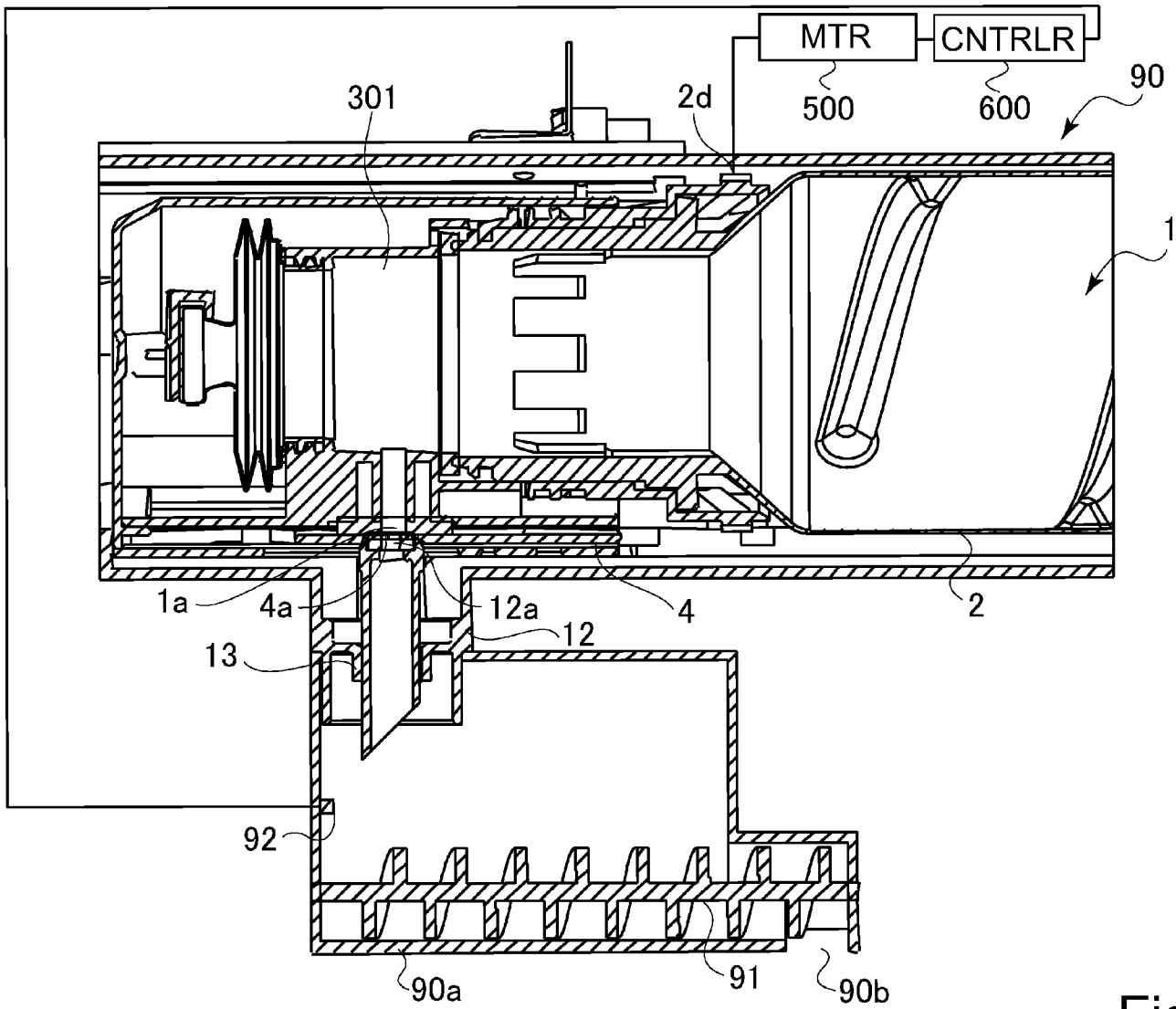

FIG. 4 is a partially sectional view showing the developer receiving apparatus in which the developer supply container is mounted.

Figure 5:
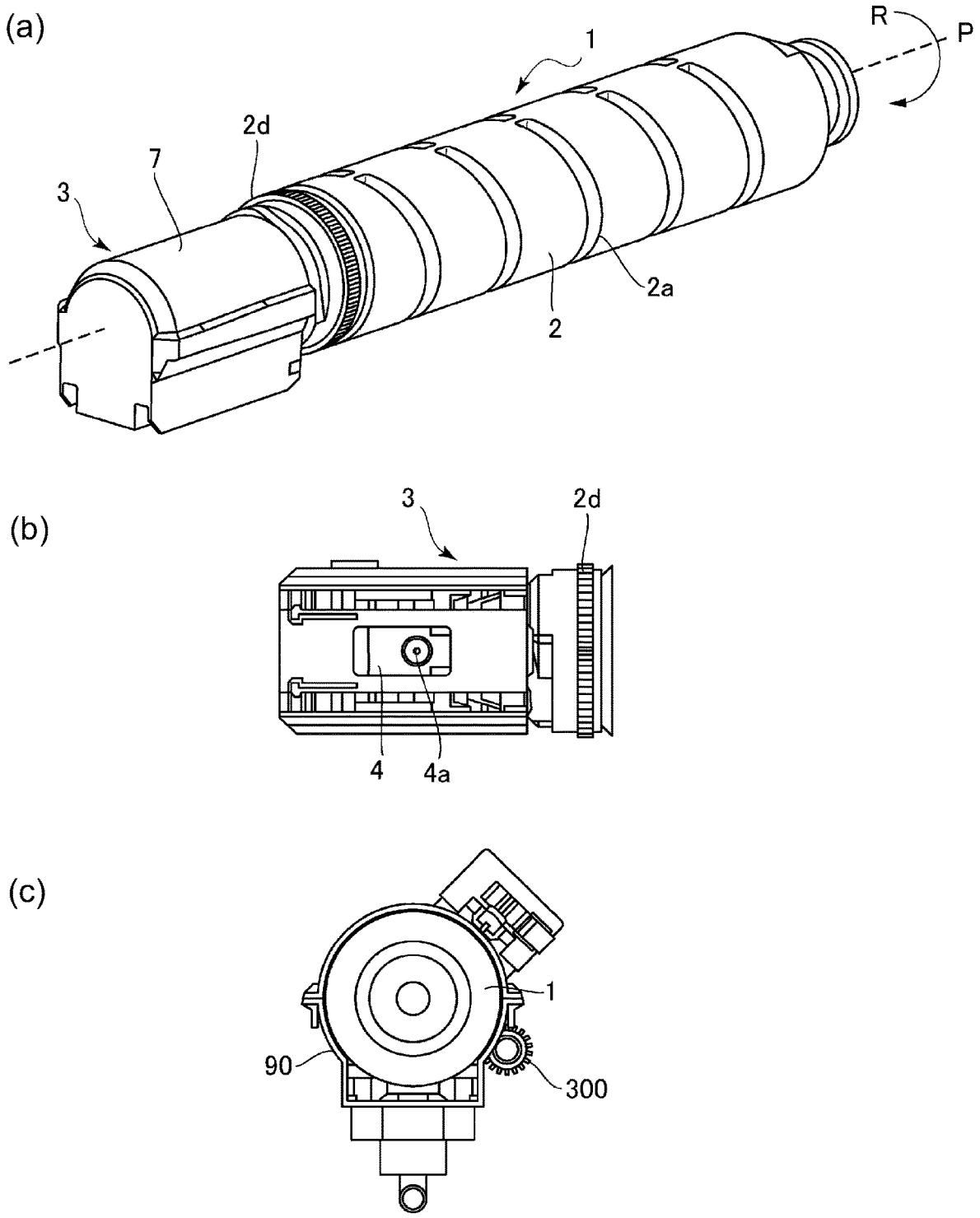

Part (a) of FIG. 5 is a perspective view of the developer supply container, part (b) of FIG. 5 is a bottom view showing a discharge opening of the developer supply container and a periphery thereof, and part (c) of FIG. 5 is a front view of the developer receiving apparatus in which the developer supply container is mounted, as seen from a front side.

Figure 6:
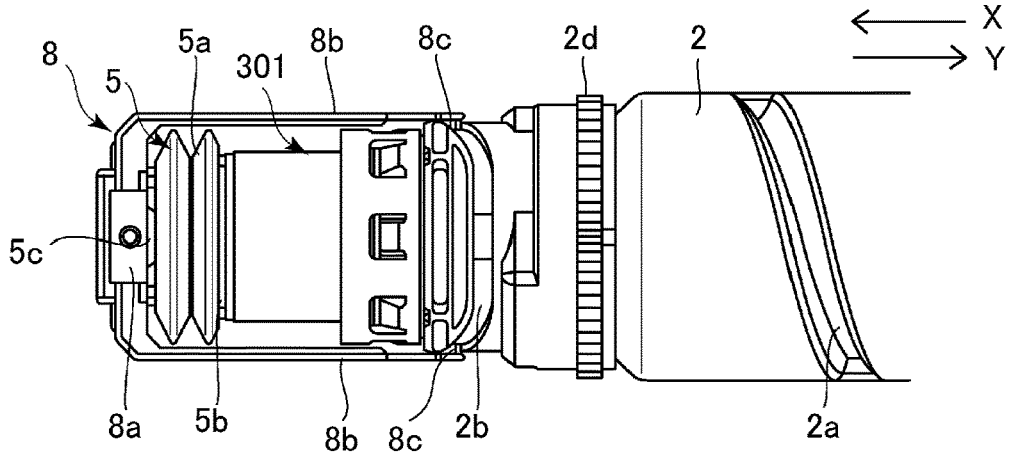
Figure 6:
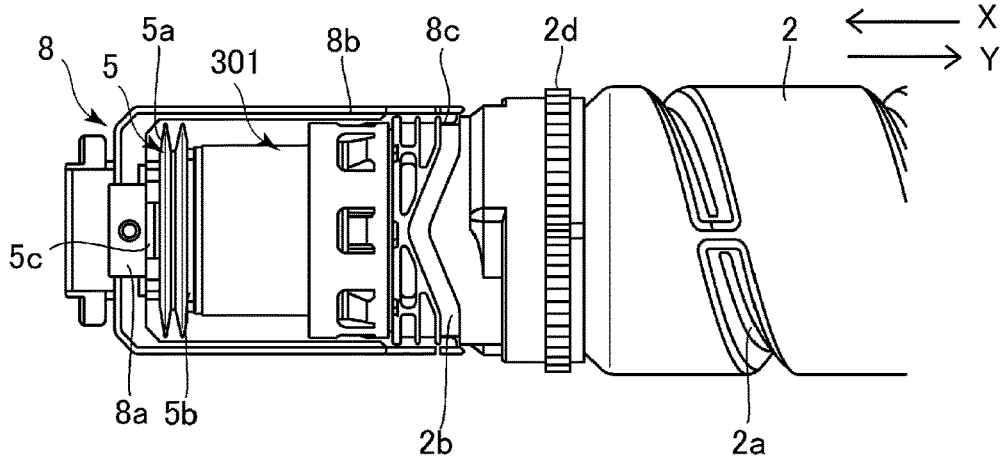
Figure 6:
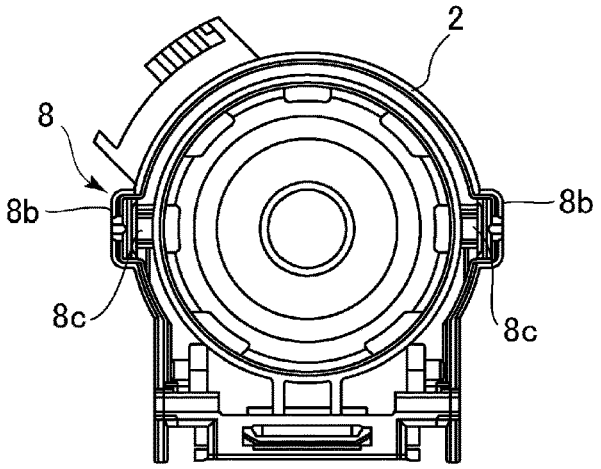

Parts (a), (b) and (c) of FIG. 6 are schematic views for illustrating the developer supply container, in which part (a) of FIG. 6 is a top (plan) view showing a state in which a pump portion is expanded to the maximum (maximum expanded state), part (b) of FIG. 6 is a top view showing a state in which the pump portion is compressed to the maximum (maximum compressed state), and part (c) of FIG. 6 is a front cross-sectional view of the developer supply container.

Figure 7:
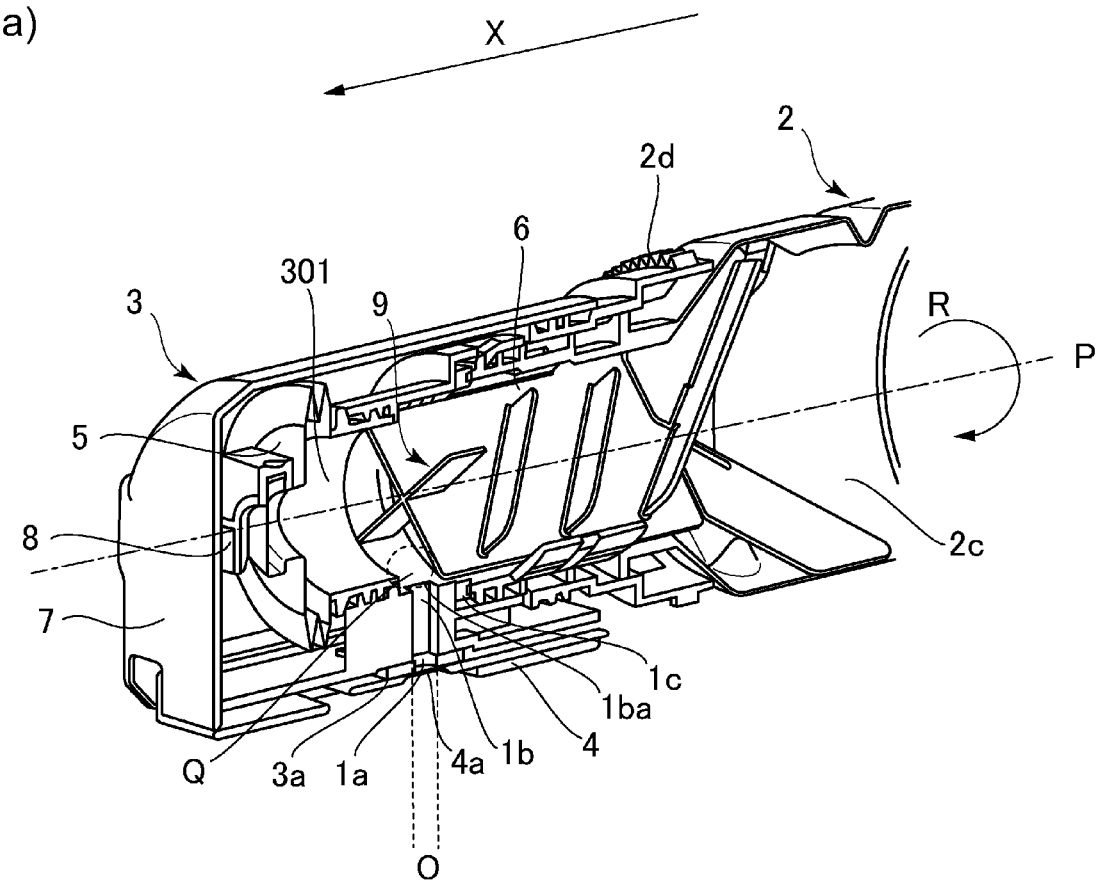
Figure 7:
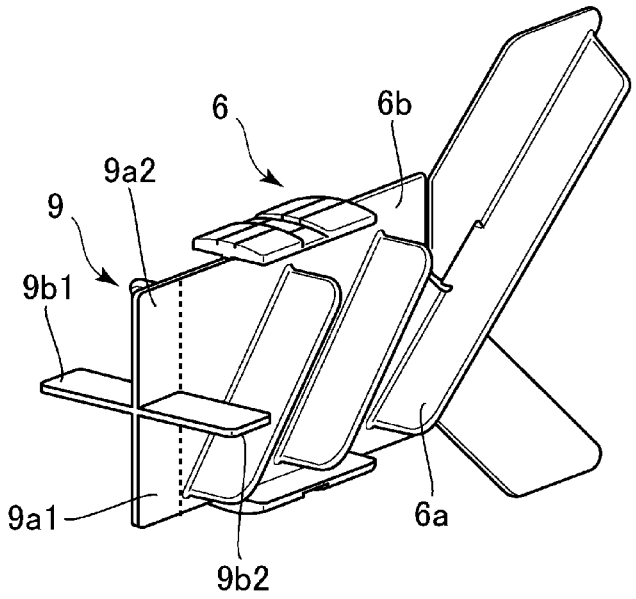

Part (a) of FIG. 7 is a perspective view showing the developer supply container, and part (b) of FIG. 7 is a perspective view showing a feeding member.

Figure 8:
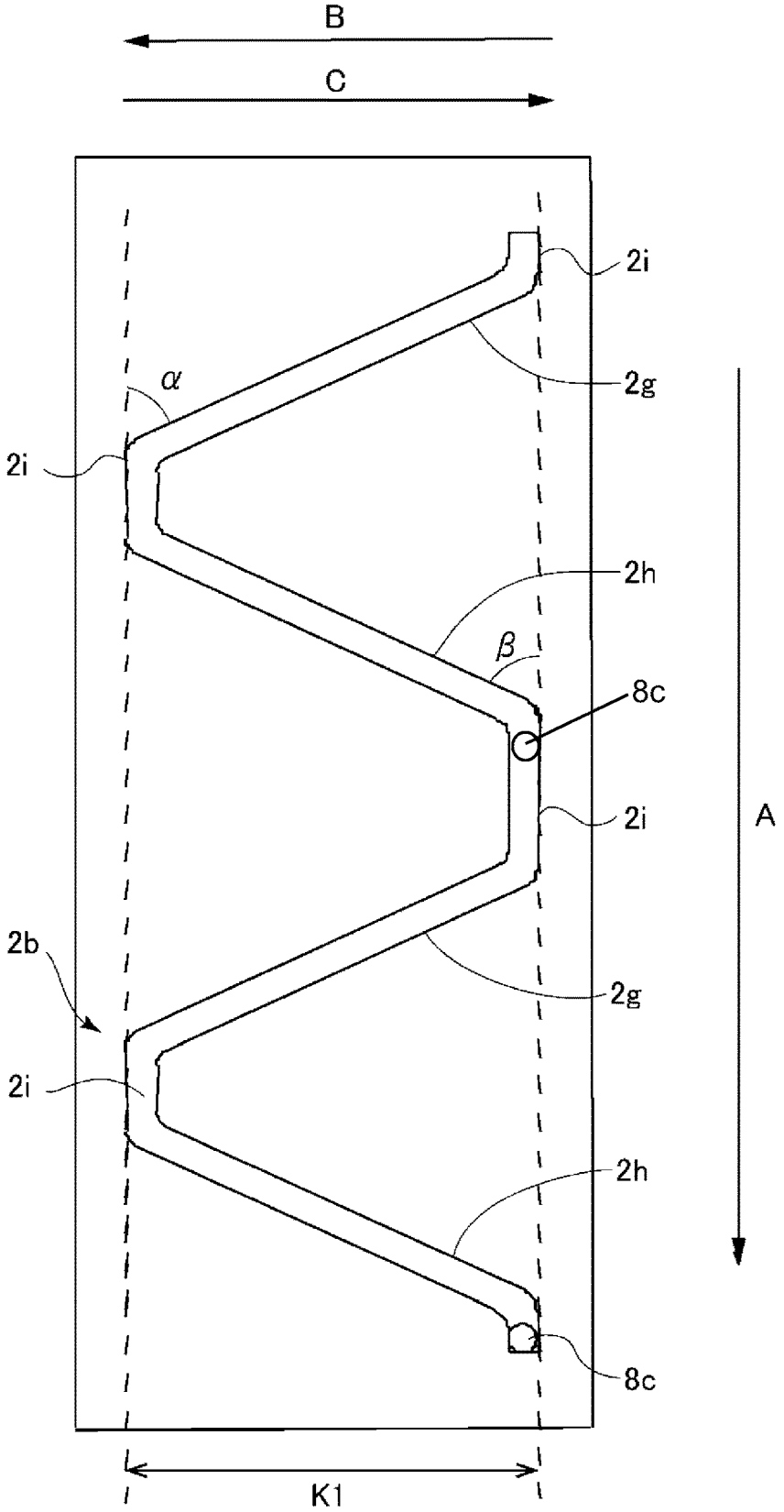

FIG. 8 is a development (view) showing a cam groove of the developer supply container.

Figure 9:
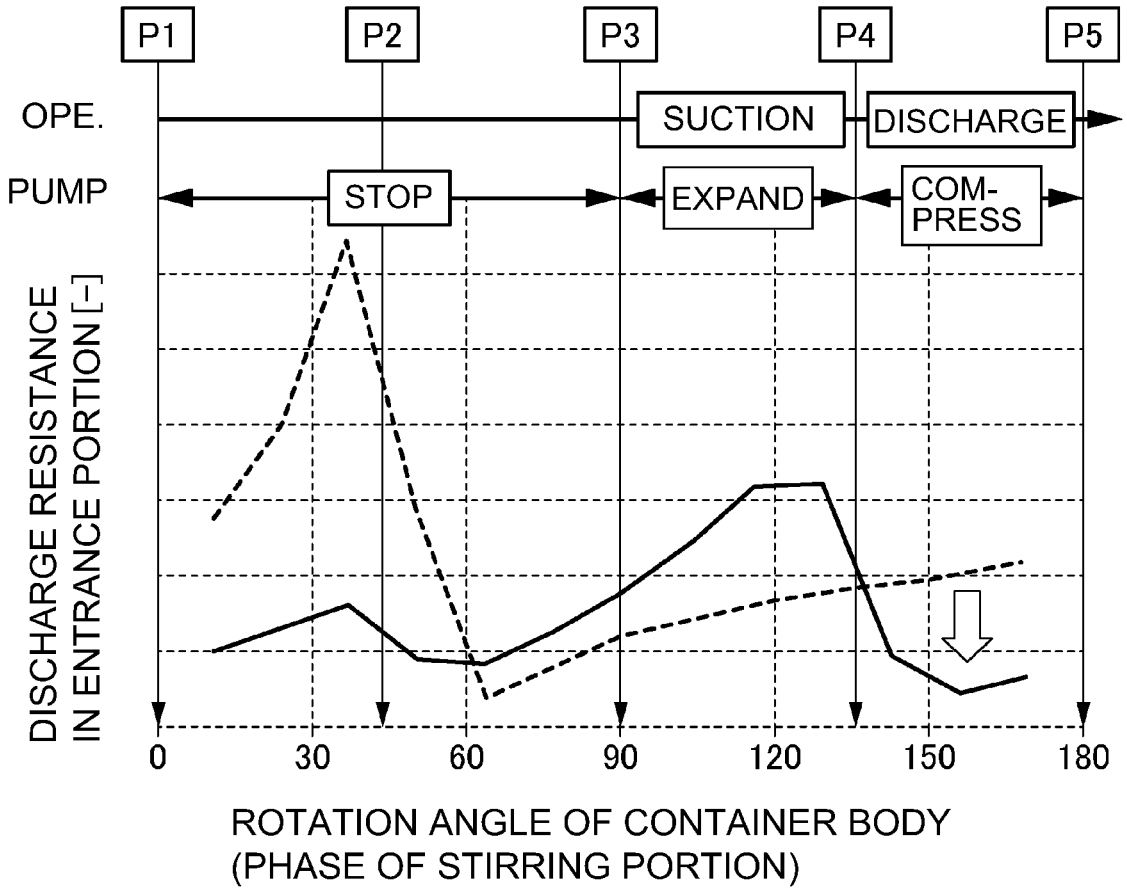

FIG. 9 is a graph showing a relationship between an angle (phase) of rotation of a stirring portion and a discharge resistance value of a developer in an inlet region.

Figure 10:
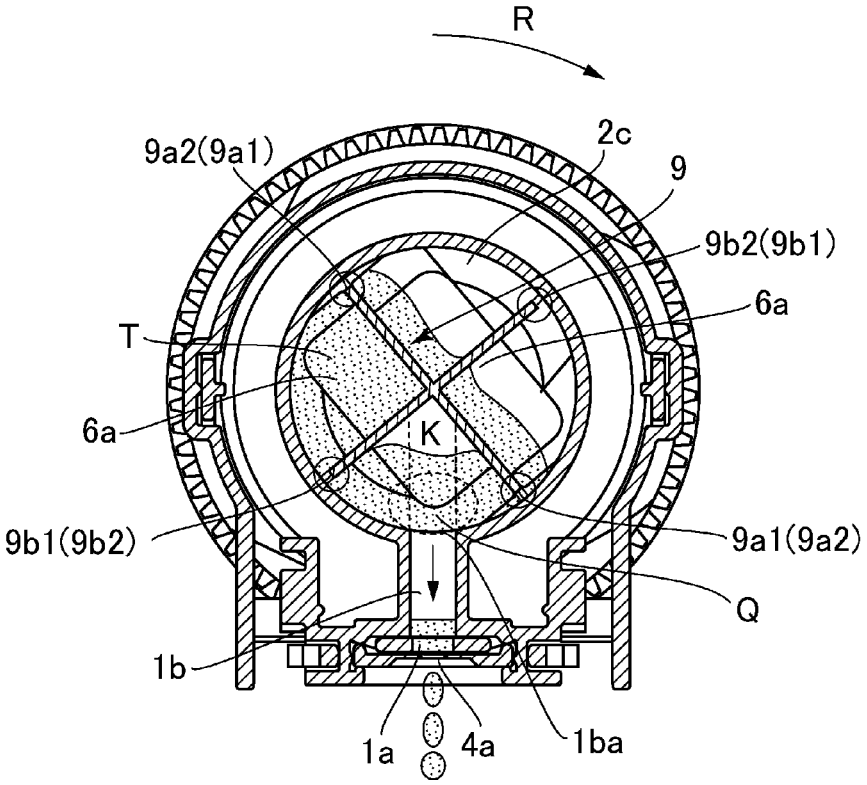
Figure 10:
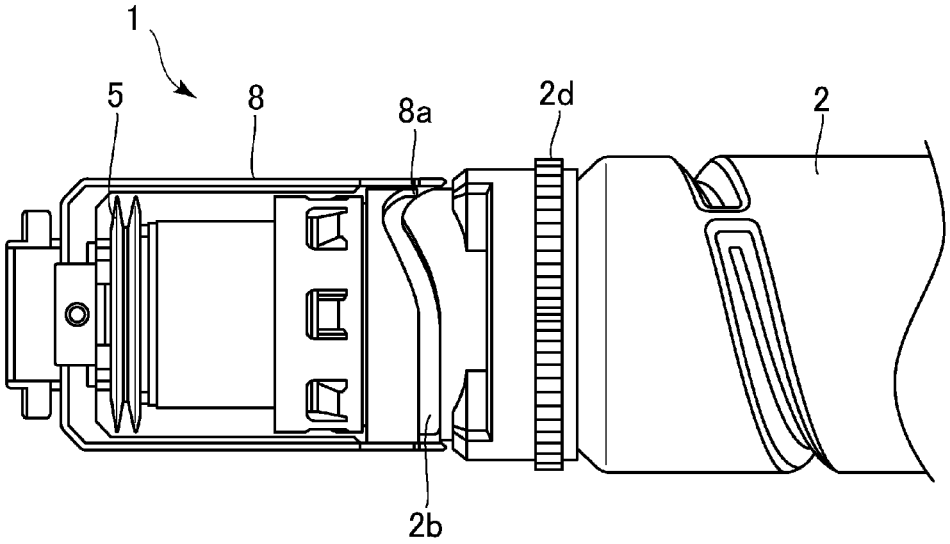

Part (a) of FIG. 10 is a front cross-sectional view showing the case where the pump portion is stopped in the maximum compressed state and part (b) of FIG. 10 is a top view showing that case.

Figure 11:
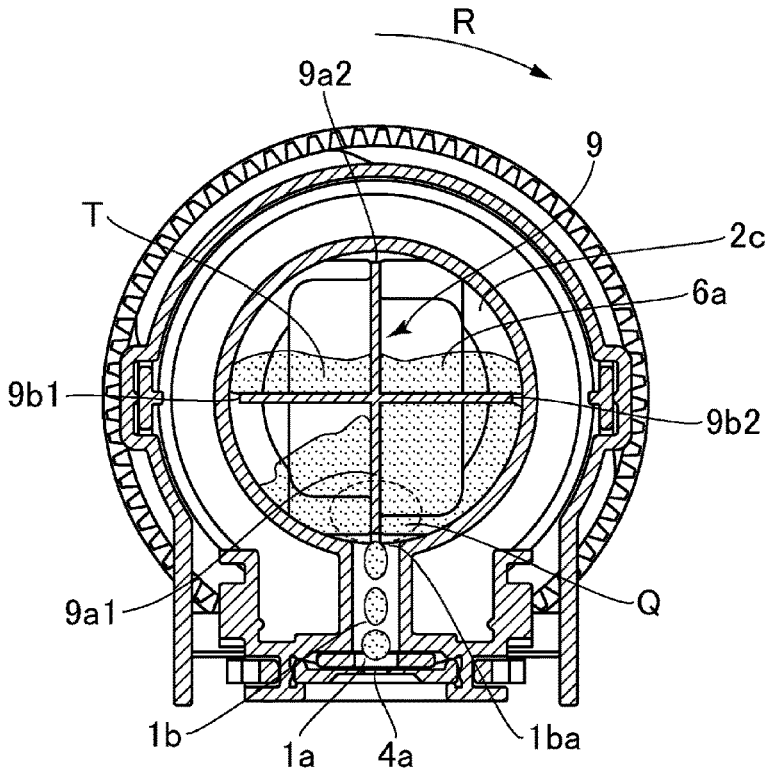
Figure 11:
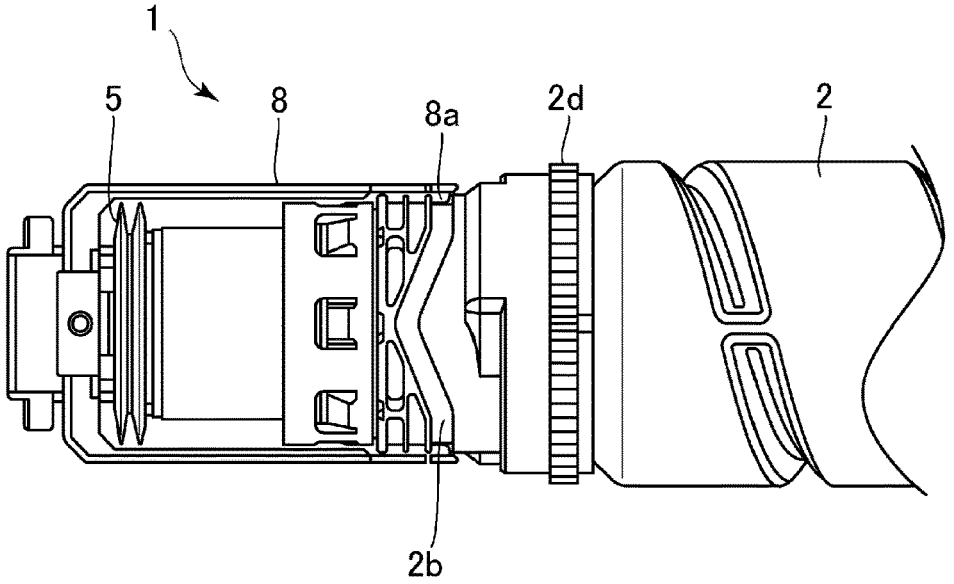

Part (a) of FIG. 11 is a front cross-sectional view showing the case where a first stirring member passes through the inlet region when the pump portion is stopped in the maximum compressed state, and part (b) of FIG. 11 is a top view showing that case.

Figure 12:
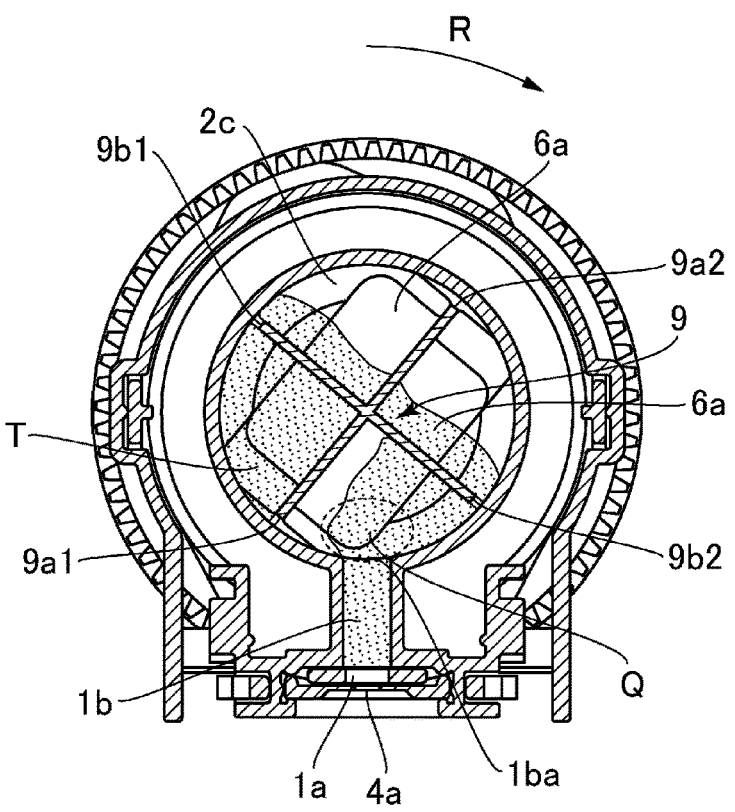
Figure 12:
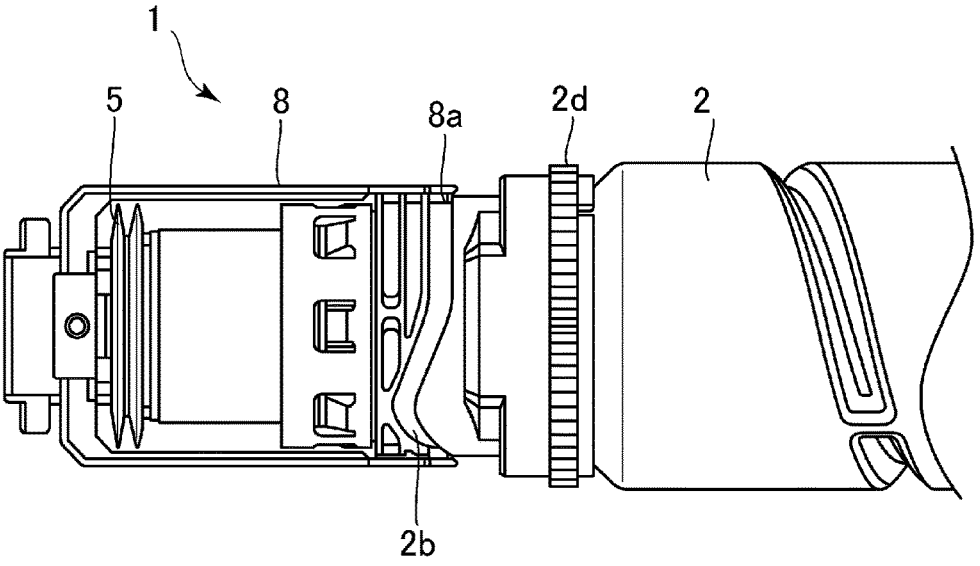

Part (a) of FIG. 12 is a front cross-sectional view showing the case where the pump portion is started to be expanded from the maximum compressed state, and part (b) of FIG. 12 is a top view showing that case.

Figure 13:
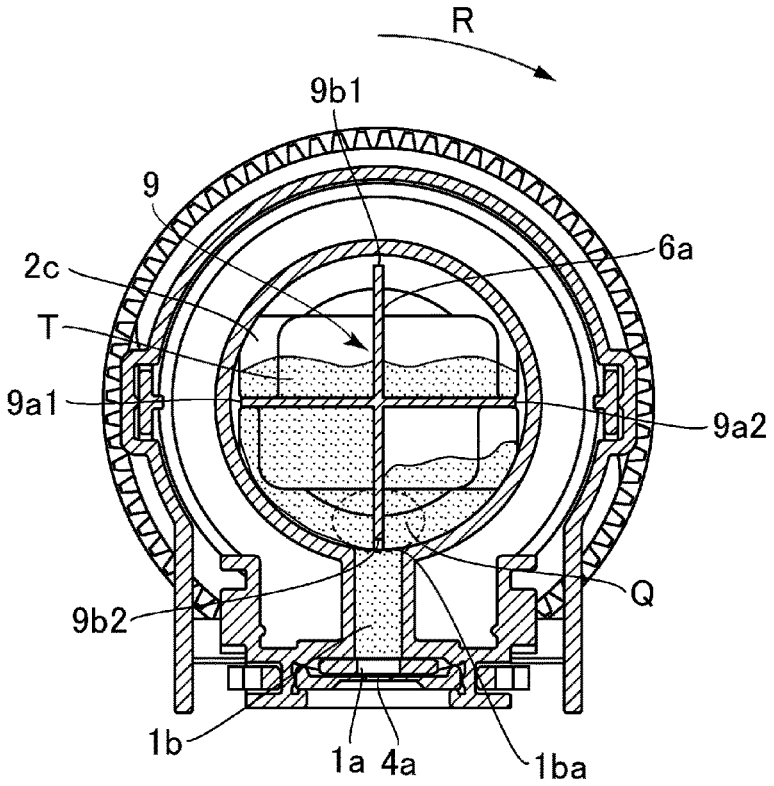
Figure 13:
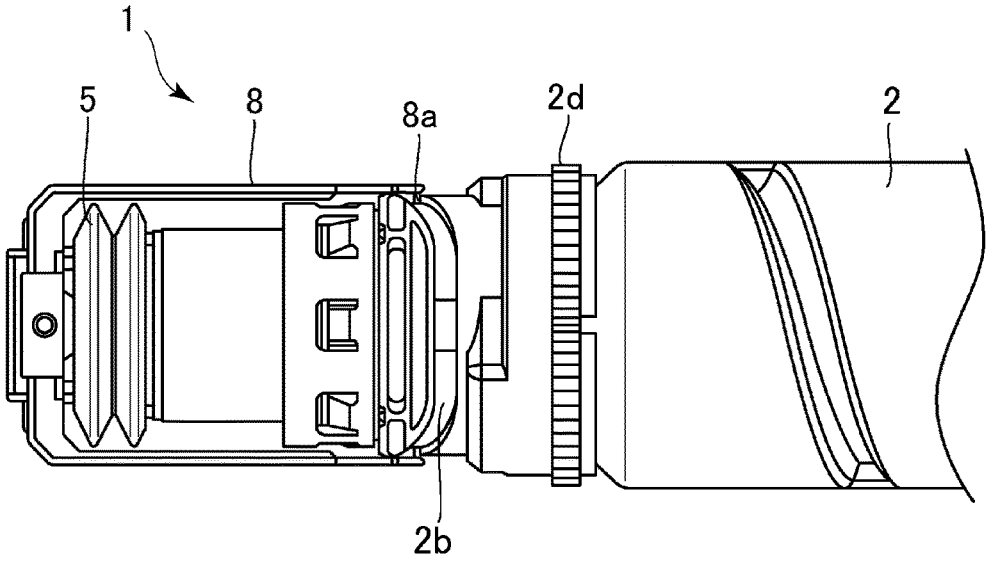

Part (a) of FIG. 13 is a front cross-sectional view showing the case where the pump portion is expanded to the maximum, and part (b) of FIG. 13 is a top view showing that case.

Figure 14:
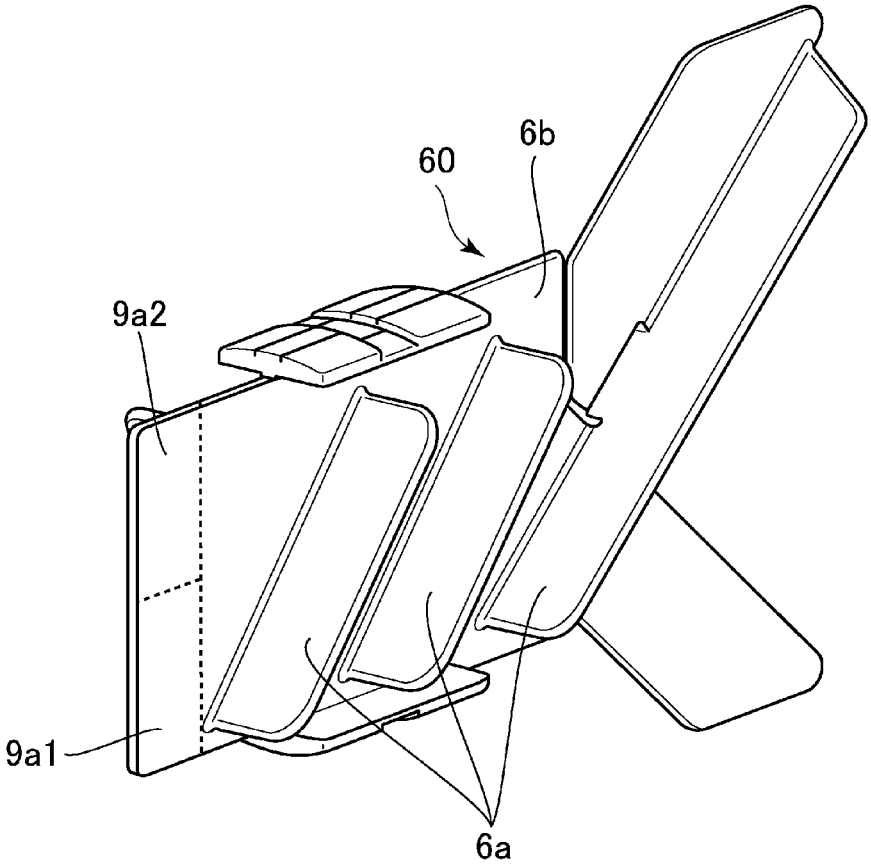

FIG. 14 is a perspective view showing a conventional feeding member.

DESCRIPTION OF EMBODIMENTS

In the following, referring to FIG. 1 and FIG. 2, a schematic structure of an image forming apparatus in which a developer supply container of this embodiment is suitably used will be described. As described specifically later, the developer supply container of this embodiment is provided so as to be mountable in and dismountable from a developer receiving apparatus mounted in a main assembly of the image forming apparatus.

Figure 1:
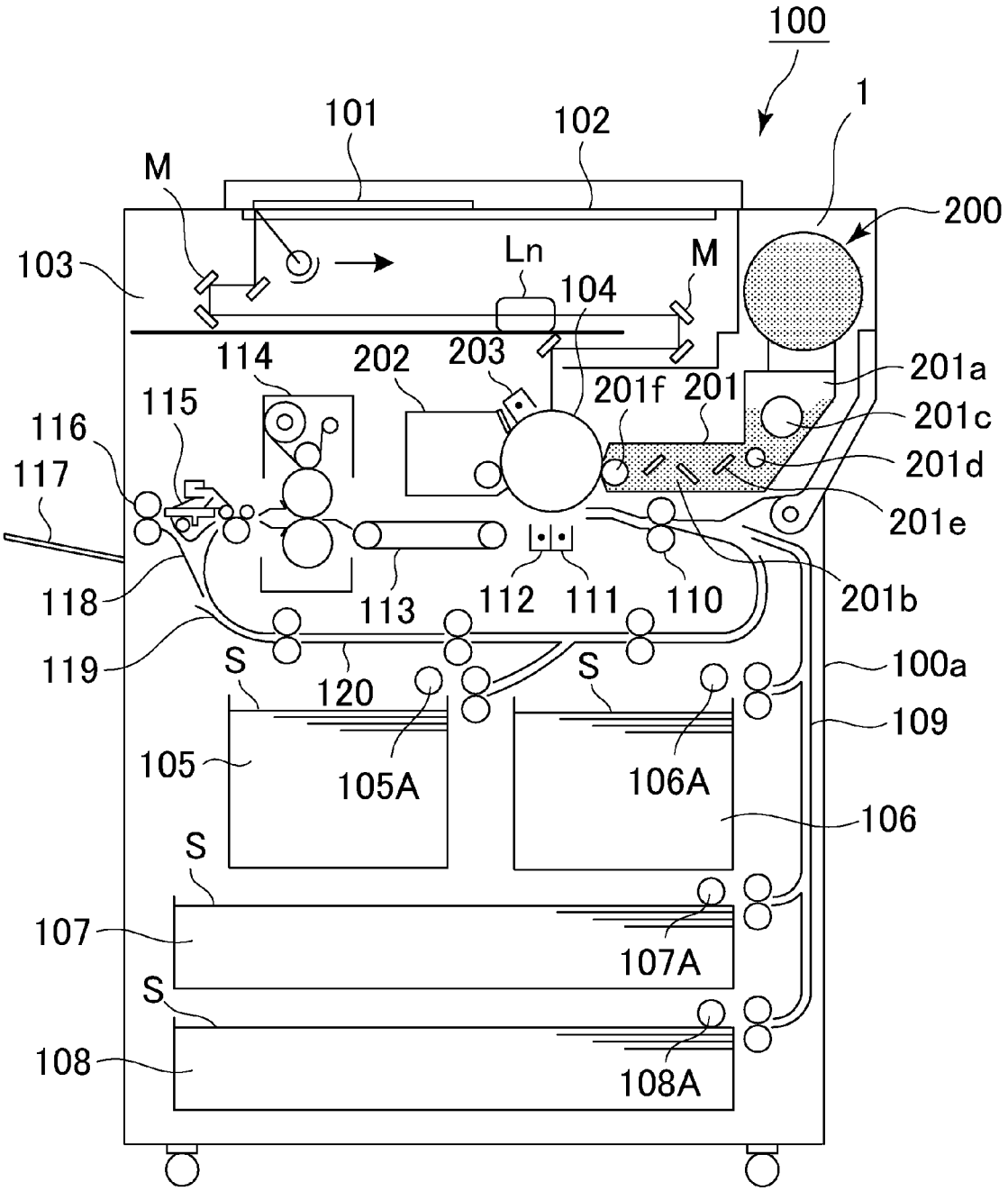
FIG. 1 is a schematic structural view of an image forming apparatus in which a developer supply container of an embodiment is suitably used.

In FIG. 1, an image forming apparatus 100 includes an original reading device 103 at a top of a main assembly 100*a* of the image forming apparatus. An original 101 is placed on an original platen glass 102. A light image corresponding to image information of the original 101 is imaged, using a plurality of mirrors M and the lens Ln of the original reading device 103, on a photosensitive drum 104 which is a cylindrical photosensitive member as an image bearing member to form an electrostatic latent image. This electrostatic latent image is visualized using toner as a developer (dry powder) by a dry type developing device (one-component developing device) 201. Here, in this embodiment, a one-component non-magnetic toner is used as the developer to be supplied from the developer supply container 1, but the present invention is not limited to such an example, and it may be of a structure as will be described hereinafter.

More specifically, in the case of using a one-component developing device which performs developing operation with one component nonmagnetic toner, one component nonmagnetic toner is supplied as a developer. In addition, non-magnetic toner is supplied as the developer when using a two-component developer which develops the image using a two component developer prepared by mixing nonmagnetic toner and magnetic carrier. In this case, as the developer, a structure may be employed in which the magnetic carrier is also supplied together with the non-magnetic toner.

As described above, a developing device 201 shown in FIG. 1 develops the electrostatic latent image formed on the photosensitive drum 104 using the toner as the developer based on the image information of the original 101. In addition, a developer supplying system 200 is connected to developing device 201, and the developer supplying system 200 includes a developer supply container 1 and a developer receiving apparatus 90 relative to which the developer supply container 1 is mountable and dismountable. Developer supplying system 200 will be described hereinafter.

The developing device 201 includes a developer hopper portion 201*a* and a developing roller 201*f*. In this developer hopper portion 201*a*, a stirring member 201*c* for stirring the developer supplied from the developer supply container 1 is provided. The developer stirred by the stirring member 201*c* is fed to a feeding member (201*e*) side by a feeding member 201*d*. And, the developer which has been sequentially fed by the feeding members 201*e* and 201*b* is carried on the developing roller 201*f* and finally supplied to a developing zone where it is opposed to the photosensitive drum 104. In this embodiment, a one-component developer is used, and therefore, toner as a developer from the developer supply container 1 is supplied to the developing device 201, but when using a two component developer, toner and carrier as a developer may be supplied from the developer supply container.

Cassettes 105 to 108 contain recording materials S such as sheets of paper. When an image is to be formed, a cassette containing an optimum recording material S among the sheets contained in these cassettes 105 to 108 is selected on the basis of the information inputted by the operator (user) or service person on the operation portion 100*d* of the image forming apparatus 100 or on the basis of the size of the original 101. Here, as for the recording material S, it is not limited to sheets of paper, but it may be an OHP sheet or the like as the case may be. One sheet of recording material S fed by the feeding and separating devices 105A to 108A is fed to registration rollers 110 by way of a feeding portion 109. Then, the recording material S is fed in synchronization with the rotation of the photosensitive drum 104 and the scan timing of the original reading device 103.

A transfer charging device 111 and a separation charging device 112 are provided at positions opposing the photosensitive drum 104 on a downstream side of the registration roller 110 in the recording material feeding direction. The image of the developer (toner image) formed on the photosensitive drum 104 is transferred onto the recording material S fed by the registration roller 110, by a transfer charging device 111. And, the recording material S onto which the toner image is transferred is separated from the photosensitive drum 104 by a separation charging device 112. Subsequently, heat and pressure are applied to the recording material S fed by the feeding portion 113 in a fixing portion 114, so that the toner image is fixed on the recording material. Thereafter, the recording material S to which the toner image is fixed passes through a discharge/reversing portion 115 and is discharged to the discharge tray 117 by the discharge roller 116, in case of single-sided copy.

On the other hand, in case of double-sided copy, the recording material S passes through the discharge/reversing portion 115, and the recording material S is partly discharged to the outside of the apparatus once by the discharge roller 116. After this, at the timing when a trailing end of the recording material S passes through the switching member 118 and is still nipped by the discharge rollers 116, the position of the switching member 118 is switched, and the discharge roller 116 is rotated counterclockwise, by which the recording material S is fed again into the apparatus. Thereafter, the recording material S is fed to the registration roller 110 by way of the re-feeding and feeding portions 119 and 120, and is discharged to the discharge tray 117 by way of the same path as in the case of single-sided copying.

In the image forming apparatus 100 having the above-described structure, image forming process devices such as a developing device 201, a cleaner portion 202, a primary charging device 203 and the like are provided around the photosensitive drum 104. Here, the developing device 201 supplies the developer to the electrostatic latent image formed on the photosensitive drum 104 on the basis of the image information of the original 101 read by the original reading device 103 so as to develop the electrostatic latent image. In addition, the primary charging device 203 uniformly charges the surface of the photosensitive drum to form a desired electrostatic latent image on the photosensitive drum 104. Furthermore, the cleaner portion 202 has a function of removing the developer remaining on the photosensitive drum 104.

Figure 2:
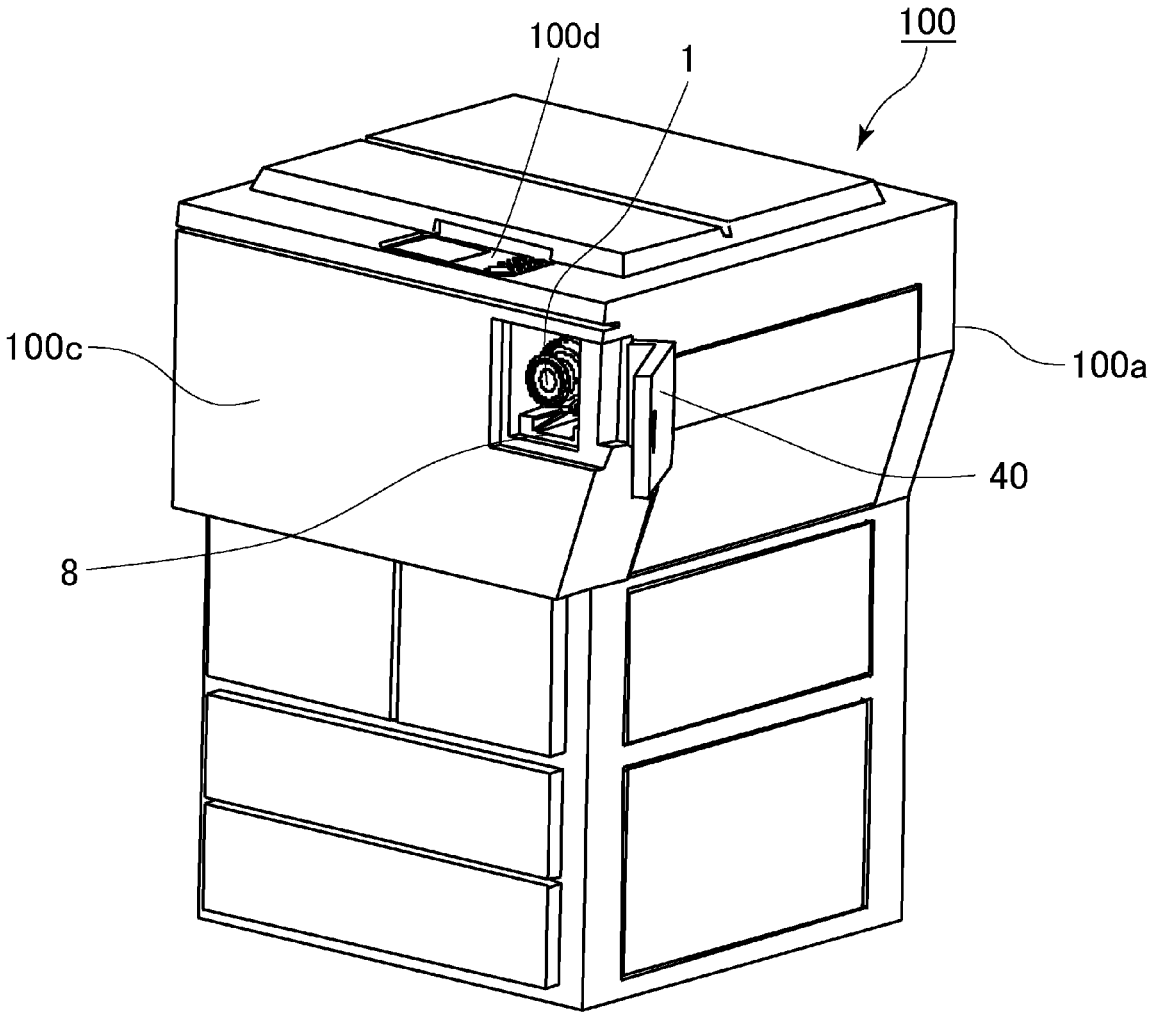
FIG. 2 is a perspective view of the image forming apparatus.

As shown in FIG. 2, when the operator opens a replacement cover 40 which is a portion of an outer cover of the apparatus main assembly 100*a* of the image forming apparatus 100, a part of the developer receiving apparatus 90 which will be described hereinafter can be seen. And, by inserting the developer supply container 1 into this developer receiving apparatus 90, the developer supply container 1 is mounted in a state where it can supply the developer to the developer receiving apparatus 90. On the other hand, when the operator exchanges the developer supply container 1, it carries out the operation opposite to the loading operation, by which the developer supply container 1 is dismounted from the developer receiving apparatus 90, and thereafter a new developer supply container 1 can be mounted. Here, the replacement cover 40 is a cover exclusively for mounting/dismounting (exchanging) the developer supply container 1, and is opened and closed only for dismounting/mounting the developer supply container 1. On the other hand, the maintenance operation for the image forming apparatus 100 is performed by opening/closing a front cover 100*c*. Here, the replacement cover 40 and the front cover 100*c* may be integrated. In such a case, the replacement of the developer supply container 1 and the maintenance of the image forming apparatus 100 are performed by opening and closing the integrated cover (not shown).

[Developer Receiving Apparatus]

Next, referring to part (a) of FIG. 3 to FIG. 4, the developer receiving apparatus 90 constituting the developer supplying system 200 will be described. The developer receiving apparatus 90 is provided with a mounting portion (mounting space) 10 to which the developer supply container 1 is dismountably mounted. The mounting portion 10 is provided with an insertion guide 11 for guiding the developer supply container 1 in the mounting and dismounting directions. In the case of this embodiment, the structure is such that the mounting direction of the developer supply container 1 is the direction indicated by X, and the dismounting direction of the developer supply container 1 is opposite to the direction X of mounting the developer supply container 1, by the insertion guide 11.

As shown in part (a) of FIG. 3, the developer receiving apparatus 90 has a driving gear 300 which functions as a driving mechanism for driving the developer supply container 1. A rotational driving force is transmitted to the driving gear 300 from a driving motor 500 (FIG. 4) by way of a driving gear train (not shown), so that the driving gear 300 applies the rotational driving force to the developer supply container 1 mounted in the mounting portion 10. Incidentally, in this embodiment, the driving gear 300 is rotated only in one direction in order to simplify control by the driving motor 500.

As shown in FIG. 4, the operation of the driving motor 500 is controlled by the control device 600. In addition to controlling the driving motor 500, the control device 600 controls overall of the image forming apparatus 100. The control device 600 has a CPU (Central Processing Unit), a ROM (Read Only Memory), and a RAM (Random Access Memory) although these elements are omitted from illustration. The CPU controls each portion while reading the program corresponding to a control procedure stored in the ROM. In addition, working data and an input data are stored in the RAM, and the CPU executes control while looking up the data stored in the RAM on the basis of the program etc.

In the mounting portion 10 of the developer receiving apparatus 90, there is provided a developer receiving portion 12 for receiving the developer discharged out of the developer supply container 1. The developer receiving portion 12 is connected to a container discharge opening 1*a* (FIG. 4) of the developer supply container 1 during a mounting operation of the developer supply container 1, and has a receiving opening 12*a* for receiving the developer discharged through the container discharge opening 1*a*. The developer receiving portion 12 is mounted so as to be movable (displaceable) in the direction in which the receiving opening 12*a* moves toward and away from the container discharge opening 1*a* (in this embodiment, the direction crossing with the direction in which the developer supply container 1 is mounted (more specifically, vertical direction relative to the developer receiving apparatus 90).

In the case of this embodiment, as shown in part (b) of FIG. 3, the developer receiving portion 12 is displaceably held by a guide seal 13 which is narrower in diameter than the developer receiving portion 12 and which is formed with at elastic member. Therefore, when the receiving opening 12*a* moves upward and downward in the vertical direction so as to move toward and away from container discharge opening 1*a*, the developer receiving portion 12 moves against a frictional force generated between itself and the guide seal 13.

In addition, as shown in part (a) of FIG. 3, a shutter stopper portion 21 is provided on the mounting portion 10 of the developer receiving apparatus 90 in the upstream side, in the mounting direction (direction of arrow X), of the developer receiving portion 12. In the developer supply container 1 which is moving relative to the developer receiving apparatus 90 during mounting and dismounting, the shutter stopper portion 21 restricts relative movement of the shutter 4 only (FIG. 4) with respect to the developer receiving apparatus 90. In this case, the shutter 4 moves relative to a portion of the developer supply container 1 other than the shutter 4, such as the container body 2 (part (a) of FIG. 5) and the like which will be described later.

Here, it is desirable that a diameter of the receiving opening 12*a* is substantially the same as or about 2 mm larger than a diameter of the shutter opening 4*a* of the shutter 4, in order to prevent the interior of the mounting portion 10 from being contaminated by the developer. For example, in the case that the diameter of the shutter opening 4*a* of the shutter 4 is a fine hole (pinhole) of about 2 mm in diameter, it is preferable that the diameter of the receiving opening 12*a* is about 3-4 mm.

As shown in FIG. 4, below the developer receiving apparatus 90 in the vertical direction, a sub-hopper 90*a* for temporarily storing the developer supplied from the developer supply container 1 is provided. The sub-hopper 90*a* is provided with a hopper opening 90*b* communicating with the developer hopper portion 201*a* (FIG. 1) which is a part of the developing device 201. Further, in the sub-hopper 90*a*, a feeding screw 91 for feeding the developer to the developer hopper portion 201*a* and a developer sensor 92 for detecting an amount of the developer accommodated in the sub-hopper 90*a* are provided. In the case of this embodiment, the driving motor 500 is controlled on the basis of the developer amount detected by the developer sensor 92, so that the developer is maintained in a state in which the developer in an amount in a predetermined range is always accommodated in the sub-hopper 90*a*.

[Developer Supply Container]

Next, the developer supply container 1 constituting the developer supplying system 200 will be described. First, referring to part (a) of FIG. 5 to FIG. 8, the structure of the developer supply container 1 of this embodiment will be described. The developer supply container 1 of this embodiment includes the container body 2, a flange portion 3, the shutter 4, a pump portion 5, a feeding member 6, a cover 7, a reciprocating member 8 and a stirring portion 9. The developer is supplied to the developer receiving apparatus 90 (specifically the sub-hopper 90*a*) in response to rotation of the container body 2 in the developer receiving apparatus 90.

[Container Body]

The container body 2 as an accommodating container is formed in a cylindrical shape and includes a developer accommodating portion 2*c* capable of accommodating the developer. Further, in this embodiment, for example, toner having a volume-average particle size (diameter) of 5 μm to 6 μm is accommodated in the developer accommodating portion 2*c* (developer accommodating portion) as the developer. As shown in part (a) of FIG. 5, the container body 2 is provided with a helical feeding groove 2*a* for feeding the developer in the developer accommodating portion 2*c* toward the flange 3 side by rotating the container body 2 in the direction of the arrow R around the rotation axis P. In addition, as shown in parts (a) and (b) of FIG. 6, a cam groove 2*b* and a drive receiving portion (gear) 2*d* for receiving a driving force from the developer receiving apparatus 90 are integrally formed over the entire periphery of the outer circumferential surface of the container body 2 on one end side. In this embodiment, the cam groove 2*b* and the drive receiving portion (gear) 2*d* are integrally formed with the container body 2, but the present invention is not limited thereto. The cam groove 2*b* or the drive receiving portion 2*d* may also be formed as a separate member and may also be integrally mounted to the container body 2. In addition, in this embodiment, the rotational force received by the container body 2 through the drive receiving portion 2*d* is converted to a driving force for reciprocating the pump portion 5 by the driving gear 300, so that rotation of the container body 2 and reciprocating motion of the pump portion 5 are realized by a single driving source.

[Flange Portion]

The flange portion 3 will be described. As shown in part (a) of FIG. 7, the flange portion 3 is mounted so as to be rotatable relative to the container body 2 about the rotation axis P. And, when the developer supply container 1 is mounted to the developer receiving apparatus 90, the flange portion 3 is held so as not to rotate in the arrow R direction relative to the mounting portion 10 (part (a) of FIG. 3). The container discharge opening 1*a* is provided at a bottom of the flange portion 3, and an opening seal 3*a* for preventing leakage of the developer is mounted and adhered to the periphery thereof. Further, at an upper portion of the opening discharge opening 1*a*, a developer storing portion 1*b* for temporarily storing the developer fed from the container body 2 in order to adjust a discharge amount of the developer to a certain amount is provided. The developer storing portion 1*b* is provided with an opening 1*ba* which opens to an inner surface of the developer accommodating portion 2*c* and is a communicating portion for establishing communication between the inside of the developer accommodating portion 2*c* and the container discharge opening 1*a*. In the case of this embodiment, the developer accommodating portion 2*a* is not limited to an inside space of the container body 2, but is a sum of inside spaces of the container body 2, the flange portion 3 and the pump portion 5 which will be described later.

The flange portion 3 is provided with the shutter 4, the pump portion 5, the feeding member 6, the cover 7 and the reciprocating member 8. The pump portion 5 is threaded at one end side of the flange portion 3, and the container body 2 is connected to the other end side with a flange seal 1*c* formed in a ring shape therebetween. The container body 2 rotates while sliding on the flange seal 1*c* compressed relative to the flange portion 3. As a result, airtightness of the developer accommodating portion 2*c* is maintained, so that the container body 2 can be rotated with no leakage of the developer from the developer accommodating portion 2*c*. Therefore, entrance of exit of the air through the container discharge opening 1*a* with an operation of the pump portion 5 which will be described later can be properly ensured.

Next, referring to part (a) FIG. 9 through part (b) of FIG. 10, the shutter 4 will be described. The shutter 4 slidable on the bottom of the flange portion 3 where the container discharge opening 1*a* is formed moves relative to the developer supply container 1 (flange portion 3). The shutter 4 has a shutter opening 4*a*, and opens and closes the container discharge opening 1*a* of the developer supply container 1 in accordance with the mounting and dismounting operation of the developer supply container 1. That is, by moving the shutter 4 relative to the developer supply container 1 in accordance with the mounting operation of the developer supply container 1, the receiving opening 12*a* (FIG. 4) of the developer receiving portion 12 and the shutter opening 4*a* communicate with each other, and in addition with the container discharge opening 1*a*. By this, the developer in the developer supply container 1 can be discharged to the receiving opening 12*a*. Thus, in this embodiment, the discharge portion 301 for discharging the developer is constituted by the flange portion 3 and the shutter 4, and the shutter 4 of the discharge portion 301 is provided with the shutter opening 4*j* as the discharge opening for discharging the developer.

In the flange portion 3, the feeding member 6 is provided so as to be rotatable integrally with the container body 2. The feeding member 6 is capable of feeding the developer from the developer accommodating portion 2*c* to the developer storing portion 1*b* by rotation thereof. In the case of this embodiment, with the feeding member 6, the stirring portion 9 is formed integrally. The stirring portion 9 rotates so as to pass through a region (hereinafter referred to as an inlet region Q) opposing the opening 1*ba* (corresponding to a developer inlet of the developer storing portion 1*b* in the developer accommodating portion 2*c* and stirs the developer existing in this inlet region Q. The feeding member 6 and the stirring portion 9 will be described later.

In the flange portion 3, the reciprocating member 8 is disposed so as to sandwich the pump portion 5 and is provided with an engaging projection 8*a* engaged in the cam groove 2*b* of the container body 2. Further, for the purposes of improving an outer appearance and of protecting the pump portion 5, the feeding member 6, the reciprocating member 8 and the stirring portion 9, the flange portion 3 is provided integrally with the cover 7 so as to cover entirety of the pump portion 5, the feeding member 6, the reciprocating member 8 and the stirring portion 9.

[Pump Portion]

Referring to parts (a) of FIG. 7, the pump portion 5 will be described using parts (a) and (b) of FIG. 6. Part (a) of FIG. 6 shows the case where the pump portion 5 is expanded to the maximum, and part (b) of FIG. 6 shows the case where the pump portion 5 is compressed to the maximum. In this embodiment, in order to stably discharge the developer through the small container discharge opening 1*a* (part (a) of FIG. 7) as described above, the pump portion 5 is provided in the developer supply container 1. The pump portion 5 is a variable displacement type pump in which a volume is changeable by a reciprocating operation. The pump portion 5 employed in this embodiment has a bellows-like stretchable member capable of expanding and contracting.

The pump portion 5 is operated so that with rotation of the container body 2 by the driving force received by the drive receiving portion 2*d*, the state of the pump portion 5 is alternately and repetitively switched between an expanded state in which internal pressure of the developer accommodating portion 2*c* is lower than atmospheric pressure (ambient pressure) and a compressed state in which the internal pressure of the developer accommodating portion 2*c* is higher than the atmospheric pressure. That is, the pressure inside the developer supply container 1 is changed by the expansion and contraction operation of the pump portion 5, and the developer is discharged by utilizing the pressure. More specifically, when the pump portion 5 is contracted, the interior of the developer supply container 1 is brought into a compressed state, and the developer is pushed out to discharge through the container discharge opening 1*a* of the developer supply container 1. In addition, when the pump portion 5 is expanded, the interior of the developer supply container 1 is brought into a reduced pressure state, and the air flows into the discharge 1 from the outside through the container discharge opening 1*a*. By the air flowing into the developer supply container 1, the developer existing in the inlet region Q in the neighborhood of the developer storing portion 1*b* (part (a) in FIG. 7) is loosened and smoothly discharged. Thus, the pump portion 5 functions as a suctioning and discharging mechanism which alternately performs a suctioning operation and a discharging operation through the container discharge opening 1*a*. In other words, the pump portion 5 functions as an air flow (current) generating mechanism which alternately and repetitively generates an air flow toward the inside of the developer supply container 1 through the container discharge opening 1*a* (during the suctioning operation) and an air flow (from the inside of the developer supply container 1) toward the outside of the developer supply container 1 through the container discharge opening 1*a* (during the discharging operation).

As shown in parts (a) and (b) of FIG. 6, in the pump portion 5, a joint portion 5*b* is provided so as to be able to be joined with the flange portion 3 on the opening end side (dismounting direction B). For example, screw threads are formed as the joint portion 5*b*. In addition, the pump portion 5 has a reciprocating member engaging portion 5*c* which engages with the reciprocating member 8 so as to be displaced in synchronism with the reciprocating member 8, which will be described hereinafter, on the other end side. Further, the pump portion 5 has a bellows-shaped expandable portion 5*a* in which crests and bottoms are alternately formed periodically. The expandable portion 5*a* is capable by being folded or expanded along the folding lines (with folding lines as the base point). Therefore, when the bellows-like pump portion 5 is employed in this embodiment, it is possible to reduce variations in volume change amount relative to the expansion and contraction amount, and therefore, it is possible to accomplish a stable volume changing operation (expansion and contraction operation).

Here, polypropylene resin may preferably be used as the material of the pump portion 5, but the present invention is not limited thereto. As for the material of the pump portion 5, any material may be used as long as it has an expansion and contraction function and is capable of changing the internal pressure of the developer accommodating portion 2*c* by changing the volume. For example, ABS (acrylonitrile-butadiene-styrene copolymer), polystyrene, polyester, polyethylene, and so on are usable. Or, rubber, other stretchable materials or the like can also be used.

[Reciprocating Member]

Referring to parts (a), (b) and (c) of FIG. 6, the reciprocating member 6 will be described. As shown in parts (a) and (b) of FIG. 6, in order to change the volume of the pump portion 5, the reciprocating member 8 is provided with an engaging projection 8*a* which engages with the reciprocating member engaging portion 5*c* provided on the pump portion. In addition, the reciprocating member 8 is provided with an engaging projection 8*b* to be engaged with the cam groove 2*b* (FIG. 8), described later, at the time of assembly. The engaging projection 8*b* is provided at the free end portion of a pair of arms 8*c* provided opposed to each other so as to extend in the mounting and dismounting direction (arrows X and Y in the Figure) from the neighborhood of the engaging projection 8*a*. In addition, the pair of arms 8 is held so as not to rotate even when the container body 2 is rotated by the cover 7 (part (b) of FIG. 7).

As a result, when the container body 2 is driven by the drive receiving portion 2*d* by the driving gear 300 (part (c) of FIG. 5), and the cam groove 2*b* rotates integrally, the reciprocating member 8 in which the engaging projection 8*b* is engaged (fitted) in the cam groove 2*b* reciprocates back and forth in the directions X and Y. Accordingly, the pump portion 5 engaged with the engaging projection 8*a* of the reciprocating member 8 by way of the reciprocating member engaging portion 5*c* expands and contracts in the direction Y and the direction X.

Thus, the reciprocating member 8 as a converting member functions as a drive converting mechanism which converts a rotation operation of the container body 2 to the expansion and contraction operation of the pump portion 5. The arm 8*c* may also be a single arm 8*c* without being provided in pair, but when the pair of arms 8*c* may preferably be used since moment does not readily generate on the reciprocating member 8 during the expansion and contraction of the pump portion 5, and therefore, the pump portion 5 smoothly performs the expand in and contraction operation.

[Cam Groove]

FIG. 8 shows an example of the cam groove 2*b* by which the pump portion 5 performs two reciprocating operations per (one) rotation of the container body 2. In FIG. 8, an arrow A shows a rotational direction of the container body 2, an arrow B shows an expansion direction of the pump portion 5, and an arrow C shows a compression direction of the pump portion 5. As shown in FIG. 8, the cam groove 2*b* includes cam grooves 2*g* for compressing the pump portion 5 and cam grooves 2*h* for expanding the pump portion 5. In order to cause the pump portion 5 to perform the two reciprocating operations, two cam grooves 2*g* and two cam grooves 2*h* are formed. Here, an angle formed by the cam groove 2*g* with respect to the rotational direction (arrow A direction) of the container body 2 is $\alpha$, an angle formed by the cam groove 2*h* with respect to the rotational direction of the container body 2 is $\beta$, and an expansion length of the pump portion 5 by the cam groove 2*b* is k1. The angles $\alpha$ and $\beta$ and the expansion length k1 are parameters for adjusting a developer discharge amount per (one) reciprocation (motion) of the pump portion 5, an expansion speed of the pump portion 5, a rotation torque of the container body 2, and the like.

Further, the cam groove 2*b* may preferably include cam grooves 2*i* formed for maintaining the pump portion 5 in a non-operating state in which the compression operation and the expansion operation are not performed. The reason why formation of the cam grooves 2*i* is preferred will be described. In the case of this embodiment, when the driving motor 500 (FIG. 4) is controlled, the pump portion 5 performs the reciprocating operation, whereby the developer in a substantially certain amount is discharged from the developer supply container 1. However, only by control of the driving motor 500, a variable volume amount of the pump portion 5 is not readily made the same every time, and therefore, the amount of the developer discharged from the developer supply container 1 is not stabilized. For example, the case where the cam groove 2*b* is constituted by the cam grooves 2*g* for causing the pump portion 5 to perform the compression operation and the cam grooves 2*h* for causing the pump portion 5 to perform the expansion operation will be considered. In this case, in order to switch the compression operation and the expansion operation of the pump portion 5, there is a need to stop the driving motor 500 during the expansion operation and the compression operation. However, even when the driving motor 500 is stopped, the container body 2 continuously rotates by inertia, so that the pump portion 5 continuously performs the reciprocating operation in interrelation with the driving motor 500 until container body 2 stops. A distance in which the container body 2 rotates by inertia depends on a rotational speed of the container body 2, and the rotational speed of the container body 2 depends on a torque exerted on the driving motor 500. As a result, when the torque exerted on the driving motor 500 is changed by the amount of the developer in the developer supply container 1, the rotational speed of the container body 2 is also changed, so that it becomes difficult to stop the pump portion 5 at the same position.

In view of above, in order to stop the pump portion 5 at the same position, the cam groove 2*b* may only be required to be provided with a region where the pump portion 5 does not perform reciprocation (motion) even during the rotation of the container body 2. Therefore, the cam groove 2*b* includes the cam grooves 2*i* for causing the pump portion 5 not to perform the compression operation and the expansion operation even when the container body 2 rotates. Each of the cam grooves 2*i* is a straight groove extending in the rotational direction (arrow A direction of FIG. 8) of the container body 2.

[During (Air) Suctioning Operation]

In this embodiment, a suctioning operation is performed by expansion of the pump portion 5, and an (air) discharging operation is performed by compression of the pump portion 5. The operation of the pump portion 5 from the maximum compressed state shown in part (b) of FIG. 6 the maximum expanded state shown in part (a) of FIG. 6 corresponds to the suctioning operation. At the time of a start of the suctioning operation, when the developer storing portion 1*b* (part (a) of FIG. 7) is filled with the developer, the developer supply container 1 is substantially in a hermetically sealed state, so that the internal pressure of the developer accommodating portion 2*c* is lower than the atmospheric pressure (outside pressure) depending on an increase in volume of the pump portion 5. Then, due to a difference in pressure between the inside and the outside of the developer supply container 1, the air outside the developer supply container 1 flows into the developer accommodating portion 2*c* from the container discharge opening 1*a* through the developer storing portion 1*b*. As a result, even in the case where a bulk density of the developer existing in the inlet region Q is high, the bulk density can be lowered by including the air in the developer existing in the inlet region Q, so that the developer can be fluidized.

[During (Air) Discharging Operation]

On the other hand, the operation of the pump portion 5 from the maximum expanded state shown in part (a) of FIG. 6 the maximum compressed state shown in part (b) of FIG. 6 corresponds to the discharging operation. At the time of a start of the discharging operation, when the developer storing portion 1*b* is filled with the developer, the developer supply container 1 is substantially in a hermetically sealed state, so that the internal pressure of the developer accommodating portion 2*c* is higher than the atmospheric pressure (outside pressure) depending on a decrease in volume of the pump portion 5. Then, due to a difference in pressure between the inside and the outside of the developer supply container 1, the air in the developer accommodating portion 2*c* passes through the developer storing portion 1*b* and flows out of the developer supply container 1 through the container discharge opening 1*a*. As a result, substantially to the developer accumulated in the developer storing portion 1*b*, the developer which has already been fluidized with the suctioning operation by the pump portion 5 passes through the developer storing portion 1*b* and is discharged through the container discharge opening 1*a*. However, as described later, conventionally, in a case such that the bulk density of the developer in the inlet region Q is high, it was difficult to discharge the developer by the suctioning and discharging operation.

[Conventional Problems]

Here, the developer supply container 1 is transported as a replacement article and is capable of being stored for a long term. Therefore, the developer is liable to be localized in the developer supply container 1, and in some instances, the bulk density of the developer in the inlet region Q becomes high beyond expectation. Even in such a case, in order to discharge the developer by the suctioning and discharging operation by the pump portion 5, it would be considered that an expansion and contraction amount of the pump portion 5 is increased, i.e., that a pump portion 5 in which a difference in volume between a maximum volume and a minimum volume is large is used. However, when such a pump portion 5 is used, upsizing of the pump portion 5 and by extension to the developer supply container 1 is caused to occur, and this is contrary to a demand for downsizing in these days. Further, a difference in pressure between the inside and the outside of the developer accommodating portion 2*c* during the compression of the pump portion 5 becomes excessively large, so that a part of the discharged developer is not received by the developer receiving apparatus 90 but is leaked out, so that the discharged developer is liable to scatter. Further, it would be considered that the pump portion 5 is caused to perform the expansion and contraction operation over a plurality of times, but in such a case, downtime of the image forming apparatus 100 required during exchange (replacement) of the developer supply container 1 becomes long, so that a lowering in productivity is invited and thus is unpreferable.

Further, in recent years, there is a demand such that the developer in a larger amount is intended to be discharged by a single suctioning and discharging operation by the pump portion 5. In such a case, a feeding amount of the developer by the feeding member 6 increases, with the result that, the bulk density of the developer in the inlet region Q (part (a) of FIG. 7) has to become high. However, conventionally, in the case where the bulk density of the developer in the inlet region Q is high, it was difficult to discharge the developer by the suctioning and discharging operation by the pump portion. This is because when the developer having a high bulk density, i.e., the developer in a large amount exists in the inlet region Q of the developer storing portion 1*b* which is an air passing path (route), during the discharging operation by the pump portion 5, the developer is capable of making the air hard to flow toward the outside. Further, during the suctioning operation by the pump portion 5, the internal pressure of the developer accommodating portion 2*c* is kept in a positive pressure state relatively to the atmospheric pressure and is not readily placed in a negative pressure state relative to the atmospheric pressure. For that reason, the air does not flow into the developer accommodating portion 2*c* with the suctioning operation by the pump portion 5, so that the developer is not readily fluidized. When fluidization of the developer in the inlet region Q cannot be realized, the developer is not readily discharged stably during the discharging operation by the pump portion 5.

In this embodiment, in view of the above-described points, the stirring portion 9 capable of stirring the developer existing in the inlet region Q is formed integrally with the feeding member 6. In the following, the feeding member 6 and the stirring portion 9 in this embodiment will be described using parts (a) and (b) of FIG. 7.

[Feeding Member]

The feeding member 6 is provided in the container body 2 so as to be rotated integrally with the container body 2. The feeding member 6 includes a base portion 6*b* and a plurality of inclined ribs 6*a* inclined toward the discharge portion 301 side with respect to a rotational axis P of the container body 2. Each of the inclined ribs 6*a* as feeding ribs is formed in a projected shape such that the inclined rib 6*a* projects from a surface of a flat plate-like base portion 6*b*. That is, the developer in the container body 2 is raised below toward above in the vertical direction by the base portion 6*b* with rotation of the container body 2. The raised developer slides down on the surface of the base portion 6*b* by gravitation and reaches the inclined ribs 6*a*. The inclined ribs 6*a* are capable of feeding, toward the discharge portion 301 side, the developer slid down on the surface of the base portion 6*b*.

[Stirring Portion]

The base portion 6*b* is provided with the stirring portion 9 on a downstream end side of the feeding member 6 with respect to the developer feeding direction. The stirring portion 9 in this embodiment is, as shown in part (b) of FIG. 7, provided with first stirring members 9*b*1 and 9*b*2 and second stirring members 9*a*1 and 9*a*2 with respect to a rotational direction (arrow R direction). In the case where the suctioning operation and the discharging operation by the pump portion 5, i.e., the reciprocating operation of the pump portion 5 is performed n times per (one) rotation of the stirring portion 9, each of the first stirring members 9*b*1 and 9*b*2 and the second stirring members 9*a*1 and 9*a*2 is formed in n pieces or more. In this embodiment, a constitution in which the pump portion 5 reciprocates two times per rotation of the stirring portion 9 is employed, and therefore, two first stirring members 9*b*1 and 9*b*2 and two second stirring members 9*a*1 and 9*a*2 are alternately disposed at 90-degree intervals with respect to the rotational direction. The first stirring members 9*b*1 and 9*b*2 and the second stirring members 9*a*1 and 9*a*2 may preferably be formed by blades each extending from a rotation center (the rotation axis P in this embodiment) of the stirring portion 9 toward an inner surface of the developer accommodating portion 2*c*. However, as shown in this embodiment, a part of the base portion 6*b* may also function as the second stirring members 9*a*1 and 9*a*2. In this case, the first stirring members 9*b*1 and 9*b*2 are formed so as to cross the base portion 6*b* with respect to a direction substantially perpendicular to the base portion 6*b*. Further, the stirring portion 9 may also be provided separately from the feeding member 6.

Further, each of the first feeding members 9*b*1 and 9*b*2 and the second feeding members 9*a*1 and 9*a*2 may preferably be formed so that with respect to the developer feeding direction of the feeding member 6, a length of a free end portion thereof opposing the opening 1*ba* is longer than a length O (part (a) of FIG. 7) of the opening 1*ba* when the feeding member passes through the opening 1*ba*. Then, the developer can be discharged further stably through the container discharge opening 1*a*.

In the case of this embodiment, the first stirring members 9*b*1 and 9*b*2 are formed so that with respect to the rotational direction of the stirring portion 9, a downstream end position of each of the first stirring members 9*b*1 and 9*b*2 reaches an opening section K (part (a) of FIG. 10) from an upstream end to a downstream end of the opening 1*ba* at the time of a start of the suctioning operation by the pump portion 5. On the other hand, the second stirring members 9*a*1 and 9*a*2 are formed so that with respect to the rotational direction of the stirring portion 9, a downstream end position of each of the second stirring members 9*a*1 and 9*a*2 reaches the opening section K at the time of a start of the discharging operation by the pump portion 5 after the associated first feeding member 9*b*1 or 9*b*2 passes through the opening section K. By providing such a stirring portion 9, even in the case where the bulk density of the developer in inlet region Q is high, the fluidization of the developer during the suctioning operation by the pump portion 5 can be realized, and in addition, stable discharge of the developer during the discharging operation by the pump portion 5 can be realized. In the following, this will be described.

An operation of the stirring portion 9 in this embodiment will be described using FIG. 9 to part (b) of FIG. 13 while making reference to part (a) of FIG. 7. FIG. 9 is a graph showing a relationship between a rotation angle (phase) of the stirring portion 9 and a discharge resistance value of the developer in the inlet region Q (entrance portion). The discharge resistance value of the developer is a value of resistance exerted when the developer is discharged through the container discharge opening 1*a* by the discharging operation by the pump portion 5 and can change depending on the bulk density, an amount, a depositing force and the like of the developer existing in the inlet region Q. When this discharge resistance value is large, the developer is not readily discharged by the discharging operation by the pump portion 5. Incidentally, in FIG. 5, the case where the discharging operation is carried out immediately after the suctioning operation by the pump portion 5, while after the discharging operation, rotation of the container body 2 is once stopped and then rotation of the container body 2 is resumed after a lapse of a certain time and thus the suctioning operation is started was shown as an example.

In FIG. 9, "P1" represents timing when the pump portion 5 is at rest in the maximum compressed state, on a phase basis (part (a) of FIG. 10), and "P2" represents timing when the second stirring member 9*a*1 passes through the inlet region Q in the case where the pump portion 5 is at rest in the maximum compressed state, on a phase basis (part (a) of FIG. 11). Further, "P3" represents timing when the pump portion 5 is started to be expanded from the maximum compressed state, on a phase basis (part (a) of FIG. 12), and "P4" represents timing when the pump portion 5 is expanded to the maximum, on a phase basis (part (a) of FIG. 13). Further, "P5" represents timing when the container body 2 is rotated 180° from "P1" on a phase basis. That is, "P1" to "P5" represent a single (one) reciprocating operation of the pump portion 5, in which "P3" to "P4" represent the suctioning operation, and "P4" to "P5" represent the discharging operation. Here, the case where the second stirring member 9*a*1 is in the position shown in part (a) of FIG. 10 is a phase "0" (rotation angle: 0°). Further, in FIG. 9, a solid line represents a discharge resistance value in the case of this embodiment, and a broken line represents a discharge resistance value in a conventional case. Here, at a position of part (a) of FIG. 13, rotation of the developer supply container 1 once stops.

A conventional feeding member 60 is shown in FIG. 14. The conventional feeding member 60 does not include the first stirring members 9*b*1 and 9*b*2 compared with the feeding member 6 (part (b) of FIG. 7) in this embodiment. In the conventional case, different from this embodiment, when the feeding member 60 is rotated from "P3" to "P4" of FIG. 9, stirring of the developer existing in the inlet region Q (part (a) of FIG. 7) by the first stirring member 9*b*2 (part (b) of FIG. 7) as shown in part (a) of FIG. 13 is not carried out. For that reason, when the feeding member 60 is rotated from "P4" to "P5", as shown in FIG. 9, the discharge resistance value of the developer is maintained in a high state compared with the discharge resistance value of the developer in this embodiment. That is, fluidization of the developer by the first stirring member 9*b*2 is not carried out, and the second stirring member 9*a*2 rotates while pushing downward the developer T existing in the inlet region Q. For that reason, the developer is not readily discharged through the container discharge opening 1*a* with the discharging operation by the pump portion 5. Particularly, in the developer supply container 1 during transportation or stored for a long term, the bulk density of the developer in the inlet region Q is high, and thus the discharge resistance value of the developer becomes further high, and therefore it becomes difficult to discharge the developer by the suctioning and discharging operation by the pump portion 5.

On the other hand, in this embodiment, when rotation of the container body 2 is started by control of the driving motor 500 on the basis of the developer amount detected by a developer sensor 92, the stirring portion 9 is rotated from "P1" to "P2" shown in FIG. 9. In that case, as shown in part (b) of FIG. 12 and part (b) of FIG. 11, the pump portion 5 of the developer supply container 1 is maintained in the maximum compressed state, and therefore, the internal pressure of the developer accommodating portion 2*c* is unchanged, so that the internal pressure is substantially equal to the atmospheric pressure. That is, the air does not flow in and out through the container discharge opening 1*a*. Further, with rotation of the container body 2, as shown in part (a) of FIG. 10 and part (a) of FIG. 11, the stirring portion 9 is rotated in the rotational direction (arrow R direction), so that a downstream end of the second stirring member 9*a*1 approaches the inlet region Q. In that process, in the inlet region Q, the developer is pushed in by the second stirring member 9*a*1, so that the bulk density of the developer becomes high temporarily. For that reason, as shown in FIG. 9, the discharge resistance value of the developer is high in the neighborhood of the phase of 35°-40°. Then, during movement of the downstream end of the second stirring member 9*a*1 from the phase of 35° to the phase of 45°, the developer T in the inlet region Q is not only stirred but also flows into the developer storing portion 1*b* and thus is stored in the developer storing portion 1*b*. With this, the developer bulk density lowers, with the result that the discharge resistance value lowers. Here, upstream and downstream mentioned refer to upstream and downstream of the stirring portion 9 with respect to the rotational direction.

Then, the stirring portion 9 rotates from "P2" to "P3" shown in FIG. 9. During the rotation, as shown in part (a) of FIG. 11 and part (a) of FIG. 12, the second stirring member 9*a*1 passes through the opening 1*ba*, while the first stirring member 9*b*2 rotates while pushing the developer T existing in the inlet region Q toward the downstream side. Further, in this case, as shown in part (b) of FIG. 11 and part (b) of FIG. 12, the pump portion 5 of the developer supply container 1 is maintained in the maximum compressed state. That is, similarly as in the above-described case where the stirring portion 9 is rotated from "P1" to "P2", there is no flow in and out of the air through the container discharge opening 1*a*. Accordingly, the developer T which has already been stored in the developer storing portion 1*b* is not discharged through the container discharge opening 1*a*, while the developer T newly flows into the developer storing portion 1*b*, and therefore, the developer storing portion 1*b* is fitted with the developer T.

Then, the stirring portion 9 rotates from "P3" to "P4" shown in FIG. 9. During the rotation, as shown in part (a) of FIG. 12 and part (a) of FIG. 13, the downstream end of the first stirring member 9*b*2 approaches the inlet region Q. In that process, in the inlet region Q, the developer T is pushed in by the first stirring member 9*b*2, but the developer storing portion 1*b* has already been filled with the developer T, so that the developer T does not newly flow into the developer storing portion 1*b*. Therefore, as shown in FIG. 9, the discharge resistance value of the developer becomes high up to the phase of about 90°-115°. Then, when the downstream end of the first stirring member 9*b*2 is positioned at the phase of 115°-135°, i.e., when the downstream end moves from the upstream end to a center of the opening 1*ba*, the developer T in the inlet region Q is stirred by the first stirring member 9*b*2. Further, in this case, as shown in part (b) of FIG. 12 and part (b) of FIG. 13, the pump portion 5 is expanded from the maximum compressed state to the maximum expanded state. That is, the suctioning operation is performed by the pump portion 5. Then, the air flows into the developer accommodating portion 2*c* through the container discharge opening 1*a*, so that the developer T existing in the inlet region Q is fluidized. In the case of this embodiment, the downstream position of the first stirring member 9*b*2 (9*b*1) reaches a section from the upstream end to the downstream end of the opening 1*ba* at the time of a start of the suctioning operation by the pump portion 5.

Further, the stirring portion 9 rotates from "P4" to "P5" shown in FIG. 9. At that time, as shown in part (a) of FIG. 13 and part (a) of FIG. 10 (however, see the reference symbols in parentheses), the first stirring member 9*b*2 passes through the opening 1*ba*, while the second stirring member 9*a*2 rotates while pushing the developer T existing in the inlet region Q toward the downstream side. In this case, the developer T which is fluidized with the above-described suctioning operation of the pump portion 5 and which exists in the inlet region Q is stirred by the first stirring member 9*b*2, so that as shown in FIG. 9, in the neighborhood of the phase of 125°-145°, the discharge resistance value of the developer abruptly lowers. With such timing when the discharge resistance value of the developer lowers, as shown in part (b) of FIG. 13 and part (b) of FIG. 10, the pump portion 5 is compressed from the maximum expanded state to the maximum compressed state. That is, the discharging operation is performed by the pump portion 5. Then, the air flows out of the developer accommodating portion 2*c* through the container discharge opening 1*a*, so that the developer T is efficiently discharged through the container discharge opening 1*a*. Incidentally, even when the rotation of the container body 2 is once stopped after the suctioning operation by the pump portion 5 (i.e., after the pump portion 5 represents the maximum expanded state), the flow-out of the air from the developer accommodating portion 2*c* is continued for a certain time until the rotation of the container body 2 is resumed.

In the case of this embodiment, the downstream position of the second stirring member 9*a*2 (9*a*1) reaches the section from the upstream end to the downstream end of the opening 1*ba* at the time of a start of the discharging operation. As an example, the downstream position of the second stirring member 9*a*2 (9*a*1) may only be required to fall within a range of ±10°, preferably ±5° on the basis of the center of the opening 1*ba*. Further, as regards the second stirring member 9*a*2 (9*a*1), the downstream position thereof may only be required to reach an upstream section on a side upstream of the center of the opening 1*ba* at the time of the start of the discharging operation.

As described above, in this embodiment, during the suctioning and discharging operation by the pump portion 5, the first stirring members 9*b*1 and 9*b*2 and the second stirring members 9*a*1 and 9*a*2 of the stirring portion 9 were caused to pass through the opening 1*ba* in the developer accommodating portion 2*c* while stirring the developer existing in the inlet region Q opposing the opening 1*ba*. As a result, in a constitution in which the developer in the developer accommodating portion 2*c* is discharged by the suctioning and discharging operation by the pump portion 5, even in the case where the bulk density of the developer in the inlet region Q is high, the developer is fluidized and then can be discharged.

In the above-described embodiment, an example in which the sub-hopper 90*a* for temporarily storing the developer supplied from the developer supply container 1 was provided below the developer receiving apparatus 90 with respect to the vertical direction was described, but the present invention is not limited thereto. For example, a constitution in which the sub-hopper 90*a* is omitted and the developer is directly supplied from the developer receiving apparatus 90 to the developing device 201 (FIG. 1) may also employed. In the case of this embodiment in which the developer is discharged by a volume-changing operation (variable volume operation) by the pump portion 5, a variation in discharge amount can be suppressed, and therefore, even when the sub-hopper 90*a* is omitted, the developer can be stably supplied to the developing device 201. Incidentally, the constitution in which the sub-hopper 90*a* is omitted is employed in many instances in the case of using a two-component developing device for carrying out development with the two-component developer in which non-magnetic toner and a magnetic carrier is mixed with each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-080905 filed on Apr. 19, 2018, which is hereby incorporated by reference herein in its entirety.

What is claimed is:

1. A developer supply container comprising:

a developer accommodating body configured to accommodate developer;

a developer discharging body communicating with the developer accommodating body and provided with a discharge opening through which the developer is dischargeable, wherein the developer accommodating body is rotatable relative to the developer discharging body;

a storing portion communicating with an inside and the discharge opening of the developer discharging body and configured to store the developer dischargeable through the discharge opening, wherein the storing portion is provided with an opening through which the developer in the developer discharging body is capable of entering the storing portion;

a pump portion capable of changing a volume thereof with a reciprocating operation for a discharging operation discharging the developer stored in the storing portion and for a suctioning operation suctioning air; and a rotatabe member including a plurality of blades and rotatable about a rotational axis of the developer accommodating body so as to pass through a region opposing the opening of the storing portion, wherein a number of the blades is not less than twice a number of times, per rotation of the rotatable member, of the reciprocating operation of the pump portion.

2. A developer supply container according to claim 1, wherein the blades includes a first blade and a second blade, and wherein the first blade and the second blade are provided so that the first blade reaches a section from an upstream end to a downstream end of the opening of the storing portion with respect to a rotational direction of the rotatable member when the suctioning operation is started and so that the second blade reaches the section when the discharging operation is started after the first blade passes through the section.

3. A developer supply container according to claim 2, wherein the second blade is provided so as to be in an upstream section of the section on an upstream side including a center of the opening when the suctioning operation is started.

4. A developer supply container according to claim 1, wherein intervals between adjacent blades are equal to each other.

5. A developer supply container according to claim 1, wherein the rotatable member includes a flat plate-shaped base portion rotatable in a rotational direction and a projected feeding rib capable of feeding the developer while projecting from a surface of the base portion, and wherein the blades are formed integrally with the base portion.

6. A developer supply container according to claim 1, wherein the pump portion is a pump of a variable volume type in which a volume of the pump portion is variable so that an internal pressure of the developer accommodating portion is alternately and repetitively switched between an expanded state in which the internal pressure is lower than atmospheric pressure and a compressed state in which the internal pressure is higher than the atmospheric pressure.

7. A developer supply container according to claim 1, wherein the pump portion is a bellow-shaped pump capable of expansion and contraction.

8. A developer supply container according to claim 1, wherein the rotatable member rotates in interrelation with rotation of the developer accommodating body.

* * * * *